United States Patent [19]

Ebmeyer et al.

[11] Patent Number: 5,076,754

[45] Date of Patent: Dec. 31, 1991

[54] APPARATUS FOR FORMING STACKS FROM CONSECUTIVELY CONVEYED, FLAT WORKPIECES

[75] Inventors: Wilfried Ebmeyer, Enger; Gunter Mattiebe, Bielefeld, both of Fed. Rep. of Germany

[73] Assignee: Windmoller & Holscher, Lengerich, Fed. Rep. of Germany

[21] Appl. No.: 551,258

[22] Filed: Jul. 11, 1990

[30] Foreign Application Priority Data

Jul. 20, 1989 [DE] Fed. Rep. of Germany ..... 3924008

[51] Int. Cl.[5] ..... B65H 31/10; B31B 1/98

[52] U.S. Cl. ..... 414/792.7; 271/168; 271/180; 271/215; 271/217; 414/27

[58] Field of Search ..... 414/27, 792.7, 793.1, 414/924, 926, 917; 83/84, 86, 90, 91, 93, 94, 75, 96, 151, 171, 277; 493/204; 271/215, 217, 180, 168

[56] References Cited

U.S. PATENT DOCUMENTS

| | | | |
|---|---|---|---|
| 2,866,642 | 12/1958 | Halvorsen et al. | 271/215 |
| 3,977,669 | 8/1976 | Duono | 271/180 |
| 3,986,701 | 10/1976 | Hopkins | 251/297 |
| 4,065,839 | 1/1978 | Pointner | 271/217 X |
| 4,275,977 | 6/1981 | Joice | 414/790.9 |
| 4,296,684 | 10/1981 | Wangermann | 271/217 X |
| 4,796,499 | 1/1989 | Achelpohl | 414/27 X |
| 4,798,573 | 1/1989 | Lagain | 493/204 |

FOREIGN PATENT DOCUMENTS

| | | | |
|---|---|---|---|
| 916178 | 12/1972 | Canada | 271/180 |
| 0153983 | 11/1985 | European Pat. Off. . | |
| 0239857 | 10/1987 | European Pat. Off. . | |
| 2902285 | 7/1980 | Fed. Rep. of Germany . | |

*Primary Examiner*—David A. Bucci
*Assistant Examiner*—Brian K. Dinicola
*Attorney, Agent, or Firm*—Fleit, Jacobson, Cohn, Price, Holman & Stern

[57] ABSTRACT

An apparatus for forming stacks from consecutively fed, flat workpieces, preferably bags, comprises a ram, which is movable up and down and serves to force the workpieces from a plane of conveyance onto a stacking plate or onto a stack formed on said stacking plate. The stacking plate is adapted to be lifted and to be lowered to an extent depending on the increasing height of the stack. In order to ensure that the ram will exert an approximately constant force on each workpiece as it is stacked, the stacking plate is adapted to be lowered against the action of a force exerted by a brake.

6 Claims, 2 Drawing Sheets

APPARATUS FOR FORMING STACKS FROM CONSECUTIVELY CONVEYED, FLAT WORKPIECES

BACKGROUND OF THE INVENTION

1. Field of the Invention

This invention relates to an apparatus for forming stacks from consecutively conveyed, flat workpieces, preferably bags, comprising a ram which is movable up and down and serves to force the workpieces from a plane of conveyance onto a stacking plate or onto a stack formed on said stacking plate, wherein the stacking plate is adapted to be lifted and to be lowered to an extent depending on the increasing height of the stack.

2. Description of the Prior Art

In an apparatus of that kind which is known from U.S. Pat. No. 3,810,420, bags which have been severed from a continuous tubular film and in a preceding working step have been provided with bottom seam welds are forced by a ram onto a pivoted stacking plate, which is adapted to be lowered against spring force and which is continually forced down by the ram to such an extent that the trailing end portions of the deposited bags extend below a step, which protrudes over the stacking plate. When the ram has been lifted from the stacking plate, the spring which biases the stacking plate raises the stacking plate so that the trailing edge portions of the bags are forced against the underside of the step. In the known apparatus the spring which biases the stacking plate is increasingly compressed as the height of the stack increases and for this reason the ram is required to exert a correspondingly increasing force. In the forming of high stacks from workpieces consisting of delicate materials, the ram may possibly damage at least the last bags of a stack.

SUMMARY OF THE INVENTION

It is an object of the invention to provide an apparatus which is of the kind described first hereinbefore and in which the ram exerts an approximately constant force on each workpiece as it is stacked.

In an apparatus of the kind described first hereinbefore that object is accomplished in accordance with the invention in that the stacking plate is adapted to be lowered against the action of a force exerted by a brake. In accordance with the invention the stacking plate is supported by a brake, by which the stacking plate is held with an approximately constant force so that the stacking plate may be forced down by the ram with a constant force regardless of the increasing height of the stack. The brake may consist of a conventional brake for exerting an adjustable braking force.

The stacking plate is suitably provided with at least one column (14), which is vertically guided in a track or bore which is fixed to the frame and a brake shoe (21) is provided, which engages said column under an adjustable braking force. Obviously the stacking plate may be provided with a special rod or a bar, which is engaged by brake shoes.

The stacking plate may be adapted to be raised by a pneumatic cylinder or the like for raising the stacking plate to a position for the formation of a new stack when a stack has been completed and removed.

In accordance with a further feature of the invention the pneumatic cylinder (16) acts on a carrying column (14), which is connected to the stacking plate (13) and which is guided in a track of the frame and is acted upon by the brake shoe (21).

The track may consist of a longitudinal bore of a track member (27), which is fixed to the frame and is formed with a transverse bore, which opens into the longitudinal bore and in which the brake shoe (21) is guided. The brake shoe is suitably supported in the transverse bore by means of a compression spring on an adjusting screw.

A row of needles which are fixed to the frame and extend through bores in the stacking plate may be provided to retain the stack so that the workpieces forced down by the ram are needled on said needles. The needles may be heatable for joining the workpieces of the stack in a block.

DETAILED DESCRIPTION OF THE PREFERRED EMBODIMENT

Figure 1:
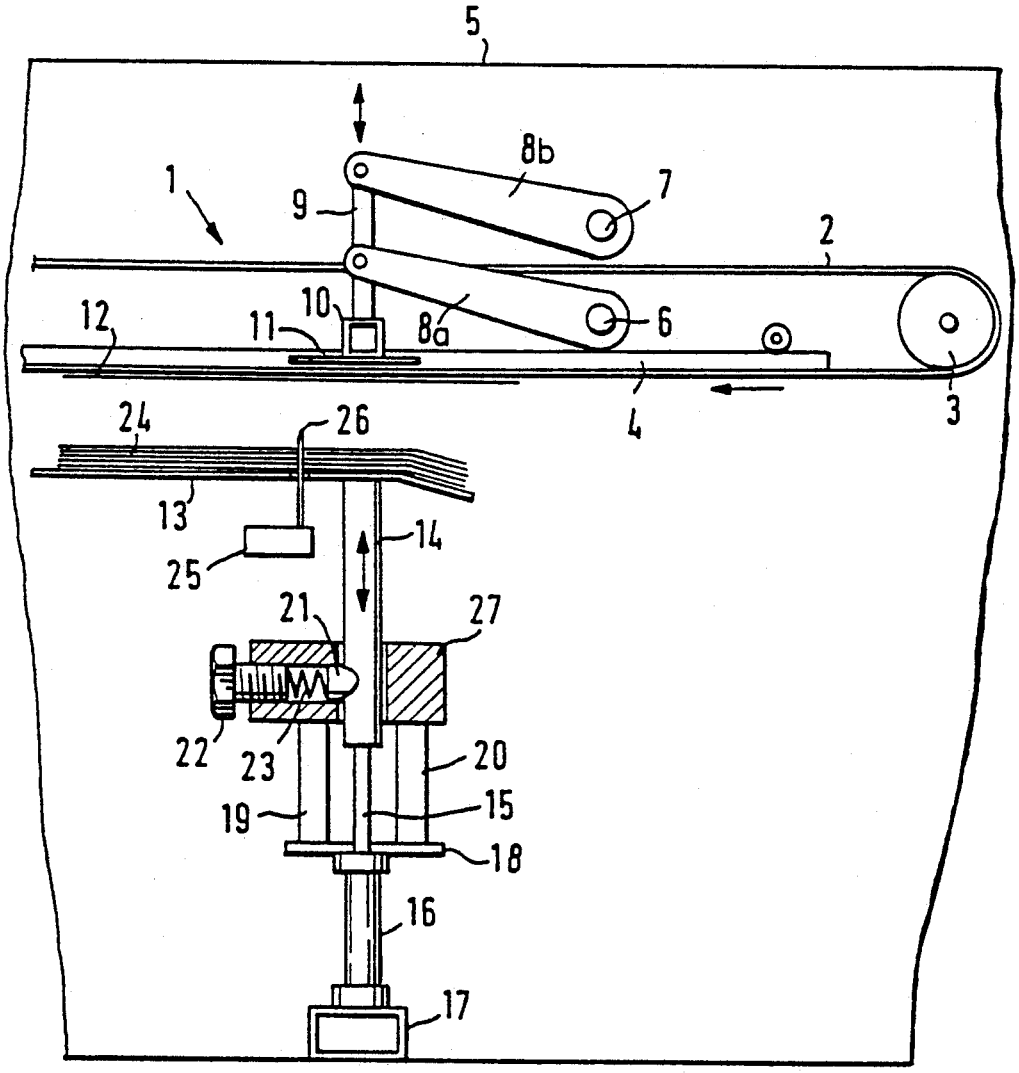
FIG. 1 is a diagrammatic side elevation showing partly in section a stacking apparatus when the ram has been raised.

Bags 12 which are to be stacked are fed to a conveyor 1 in the usual manner by a transfer conveyor, not shown. The conveyor 1 consists of two spaced apart, endless perforate conveying belts 2, which are trained around and revolve around reversing pulleys, of which only the reversing pulley 3 is shown. The two perforate conveying belts 2 revolve in parallel planes. The lower courses of the two conveyor belts move in a known manner in contact with the underside of suction boxes 4. the conveyor 1 thus consists of a suction belt conveyor, in which the bottom course is conveying.

The reversing pulley 3 is held by two side walls, of which only the side wall 5 is shown, and is rotatably mounted in said side walls. A pivot 6 and a shaft 7 are also rotatably mounted in the side walls. Drive means, not shown, can be operated to rotate the shaft 7 in opposite directions. Parallel-motion links 8*a* and 8*b* are mounted on the pivot 6 and on the shaft 7. The lower link 8*a* is freely rotatably mounted on the pivot 6 and the upper link 8*a* is non-rotatably connected to the shaft 7. At their free ends, the parallel-motion links 8 carry a ram 9, which extends through the space between the two conveying belts 2. A holder 10 is connected to the bottom end of that ram 9 and carries a depressing plate 11. The dimensions of the holder 10 and of the plate 11 are so dimensioned that they can be moved from the position shown in FIG. 1 through the space between the two conveying belts 2 to the position shown in FIG. 2. During that movement the depressing plate 11 forces an arriving bag 12 down onto a stacking plate 13. That stacking plate is secured to a carrying column 14, which at its end that is remote from the stacking plate 13 is supported by the piston rod 15 of a pneumatic cylinder 16. The pneumatic cylinder 16 is fixed to a crossbeam 17. The pneumatic cylinder 16 supports a retaining plate 18, which supports two columns 19 and 20, which are fixed to a track member 27, in which the carrying column 14 is guided. The track member 27 is formed with a horizontally extending bore, in which a braking member 21 is slidably mounted, which partly extends around the carrying column 14. The pressure under which the braking member 24 engages the carrying column 14 can be adjusted by means of an adjusting screw 22 and a spring 23. During the stacking operation the pneumatic cylinder 16 is relieved from pressure so that the force to be exerted by the parallel-motion links 8 will always be constant regardless of the height of a stack 24. The force to be applied by the parallel-motion links must only be so strong that it will overcome the friction between the braking member 21 and the carrying column 14.

A row of needles 26 are mounted on a crossbeam 25 and are adapted to extend through holes formed in the stacking plate 13 and in the depressing plate 11 so as to hold the several bags 12 in a stack 24 and to join them in a block if the needles are heated.

Figure 2:
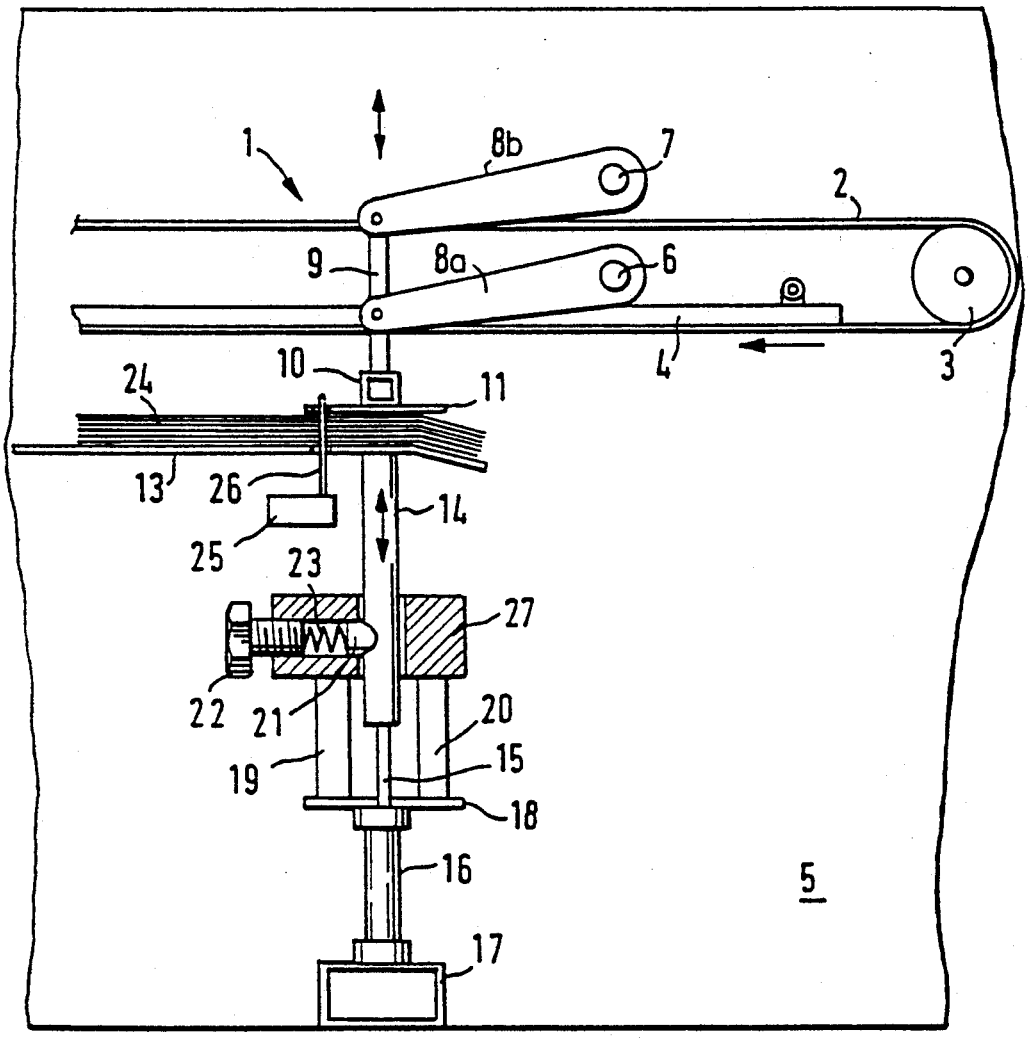
FIG. 2 is a view which is similar to FIG. 1 and shows the stacking apparatus with the ram lowered onto the stack.

When a stack 24 has been completed, the depressing plate 11 is raised to the position shown in FIG. 1 and the piston 15 is extended so that the bags are stripped from the needles 26 and can be taken from the stacking table.

We claim:

1. Apparatus for forming stacks from consecutively conveyed substantially flat workpieces comprising a vertically moveable stacking plate, a vertically reciprocable ram above the stacking plate for pushing successive workpieces from a plane of conveyance onto the stacking plate and for pushing the stacking plate down so as to compensate for a continually increasing height of a stack formed on the stacking plate as the number of workpieces in the stack increases and brake means for providing a resistance to downward movement of the stacking plate, said resistance being substantially constant over a vertical range of movement of the stacking plate and being overcome by downward force exerted on the stacking plate by the ram.

2. Apparatus as claimed in claim 1 wherein the stacking plate is mounted on a vertical column and the brake means comprises a brake shoe engaging the column.

3. Apparatus as claimed in claim 2 including brake shoe adjusting means for selectively adjusting a force of engagement between the brake shoe and the column.

4. Apparatus as claimed in claim 3 wherein the column extends through a vertical bore in a frame member which has a horizontal bore supporting the brake shoe and wherein the adjusting means comprises an adjusting nut threaded in the horizontal bore and a spring between the nut and the brake shoe.

5. Apparatus as claimed in claim 2 including a piston-cylinder assembly attached to the column for raising the stacking plate to a stack forming commencement position.

6. Apparatus as claimed in claim 1 including upwardly projecting stacking needles on the stacking plate.

* * * * *